US006431030B1

(12) United States Patent
Kuo et al.

(10) Patent No.: US 6,431,030 B1
(45) Date of Patent: Aug. 13, 2002

(54) ADJUSTING STRUCTURE FOR A RATCHET WRENCH

(76) Inventors: Wen-Jin Kuo; Wen-Chin Kuo, both of 7F, No. 185, Sec. 2, Nan-Tun Rd., Taichung (TW)

( * ) Notice: Subject to any disclaimer, the term of this patent is extended or adjusted under 35 U.S.C. 154(b) by 0 days.

(21) Appl. No.: 09/902,564

(22) Filed: Jul. 12, 2001

(51) Int. Cl.[7] ..... B25B 13/46
(52) U.S. Cl. ..... 81/63; 81/63.2
(58) Field of Search ..... 81/63, 63.2, 62, 81/63.1, 61, 60

(56) References Cited

U.S. PATENT DOCUMENTS 1,455,147 A * 5/1923 O'Neill ..... 81/61
1,868,840 A * 7/1932 McNaught et al. ..... 81/61
2,978,081 A * 4/1961 Lundin ..... 192/43.1
3,140,625 A * 7/1964 Pannozzo ..... 81/63
5,568,751 A * 10/1996 Lee ..... 81/63

FOREIGN PATENT DOCUMENTS

JP 0-2000117648 A * 4/2000 ..... B25B/13/46

* cited by examiner

*Primary Examiner*—James G. Smith
*Assistant Examiner*—David B. Thomas
(74) *Attorney, Agent, or Firm*—Charles E. Baxley

(57) ABSTRACT

An improved adjusting structure for a ratchet wrench having a tool handle. One end of the tool handle is provided with an open chamber sealed by a seal piece. The chamber is provided with a trigger structure including: a ratchet wheel disposed at an end portion of the chamber; a positioning groove provided in a wall of another end portion of the chamber; a trigger block having one end portion disposed in the positioning groove, the other end portion and the ratchet wheel being provided with two confronting toothed faces, the trigger block being swingable left and right in the positioning groove; and a trigger structure disposed outside the chamber and being operable to control the trigger block such that one of the toothed faces engages the ratchet wheel.

9 Claims, 8 Drawing Sheets

ADJUSTING STRUCTURE FOR A RATCHET WRENCH

BACKGROUND OF THE INVENTION (a) Field of the Invention

The present invention relates to a wrench tool, more particularly to an improved adjusting structure for a ratchet wrench.

(b) Description of the Prior Art

Referring to FIGS. 1 and 2, a conventional ratchet wrench essentially includes a chamber with an open bottom provided at a working end at a head portion of the wrench. One end of the chamber is provided with a ratchet wheel. The center of the ratchet wheel is connected to a drive rod. The center of the drive rod is provided with a movable type insert control member that controls the drive rod to stably couple with a workpiece or another fitting member. The insert control member is controlled via a push button extending out of the drive rod and a top face of the chamber. The other end of the chamber is provided with two curved grooves in a wall surface thereof for limiting base portions of two trigger blocks. Open ends of the two trigger blocks have teeth that are engageable with peripheral teeth of the ratchet wheel. An eccentric push rod is disposed between the two trigger blocks. The push rod is controlled via a trigger rod provided at a top face of the wrench. Two side walls of the chamber are respectively provided with springs urging against the trigger blocks.

The trigger rod is manipulated to cause the push rod to push away one of the trigger blocks so that the push block compresses the corresponding spring, and the teeth of the trigger block disengage from the ratchet wheel. On the contrary, the other trigger block or the urging action of the other spring causes the teeth to engage with the ratchet wheel. Thus, operation of the wrench can produce a predetermined operating direction, or conversely, the wrench is in idle rotation to return to its original position.

The above-described conventional ratchet wrench has the following disadvantages:

1. The torque of the wrench is small. The number of teeth that can be provided at the end portion of the elongated trigger block is limited. Insufficient number of engageable teeth between the ratchet wheel and the trigger block results in small torque of the wrench, which may cause wear or damage of the teeth during operation. Besides, engagement is not assured, which may affect operation of the wrench.

2. A large number of components make assembly inconvenient and time-consuming. During assembly, the two trigger blocks have to be disposed first. Then, the eccentric push rod is assembled, and it has to be noted that rotation of the push rod can push away one of the trigger blocks. Next, the push rod and the push rod are coupled. Subsequently, two springs are fitted between the two trigger blocks and the two side walls. Assembly is very completed and time-consuming.

3. Positioning of the components is not secure. The springs are simply mounted by fitting without any positioning means and may easily become disengaged. The base portions of the two trigger blocks are only limited in the two curved grooves and may disengage in the direction of the ratchet teeth. These problems seriously affect the operation and durability of the wrench.

SUMMARY OF THE INVENTION

The main object of the present invention is to provide an improved adjusting structure for a ratchet wrench, in which the wrench can bring a workpiece to rotate in an action direction or to perform idle rotation in a reverse direction back to its original position. In addition, the present invention can be quickly assembled and positioned, and the torque of the wrench can be increased. Furthermore, the wrench can drive the workpiece with a stable and uniform force, thereby enhancing operability and durability of the wrench.

In order to achieve the aforementioned object, the improved adjusting structure according to the present invention is adapted for use in a tool handle. One end of the tool handle is provided with an open chamber sealed by a seal piece. The chamber is provided with a trigger structure including: a ratchet wheel disposed at an end portion of the chamber; a positioning groove provided in a wall of another end portion of the chamber; a trigger block having a circular block-shaped base portion and a toothed block expanding radially outward from the base portion, the base portion being disposed in the positioning groove, the base portion of the trigger block being centrally provided with a polygonal hole; a trigger structure including a disk portion, one side of the disk portion being provided with a shaft that is provided with a polygonal block, the shaft extending into the trigger block, the polygonal block fitting into the polygonal hole; a positioning assisting structure including at least one through hole formed in the toothed block of the trigger block, the through hole having a spring fitted therein. The spring has two ends, each of which is provided with a positioning ball. The positioning ball has an end portion provided with a positioning rod extending through and being retained in the spring. The wall surface of the chamber and the seal piece are respectively provided with hemispherical recesses at positions corresponding to positions adjacent to the positioning balls such that when the trigger block is actuated by the trigger structure to slant and the toothed face on one side engages the ratchet wheel, the peripheral surfaces of the two positioning balls can engage the hemispherical recesses on the same side.

BRIEF DESCRIPTION OF THE DRAWINGS

The foregoing and other features and advantages of the present invention will be more clearly understood from the following detailed description and the accompanying drawing, in which.

DETAILED DESCRIPTION OF THE PREFERRED EMBODIMENT

Figure 1:
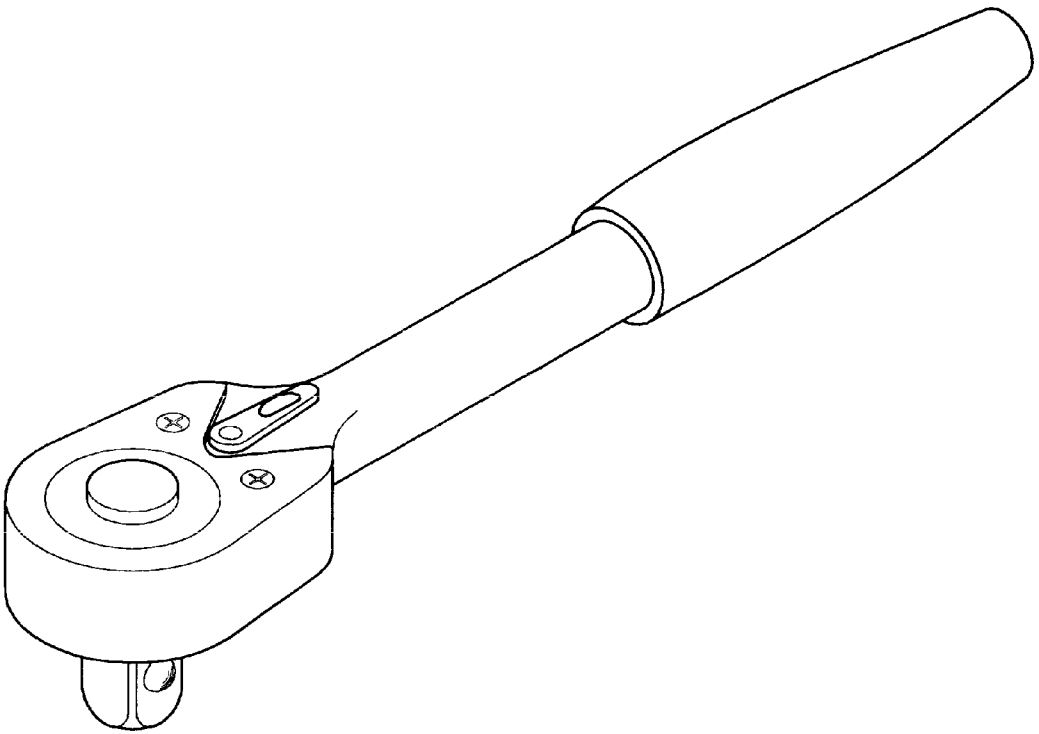
Fig.1 PRIOR ART
FIG. 1 is a perspective view of a conventional wrench.
Figure 2:
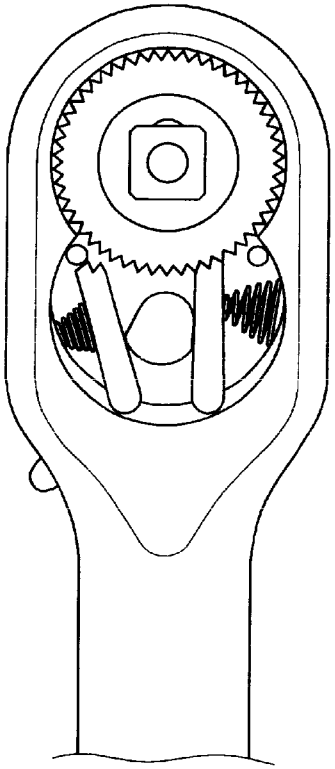
Fig.2 PRIOR ART
FIG. 2 is a plan view showing the internal construction of the conventional wrench.
Figure 3:
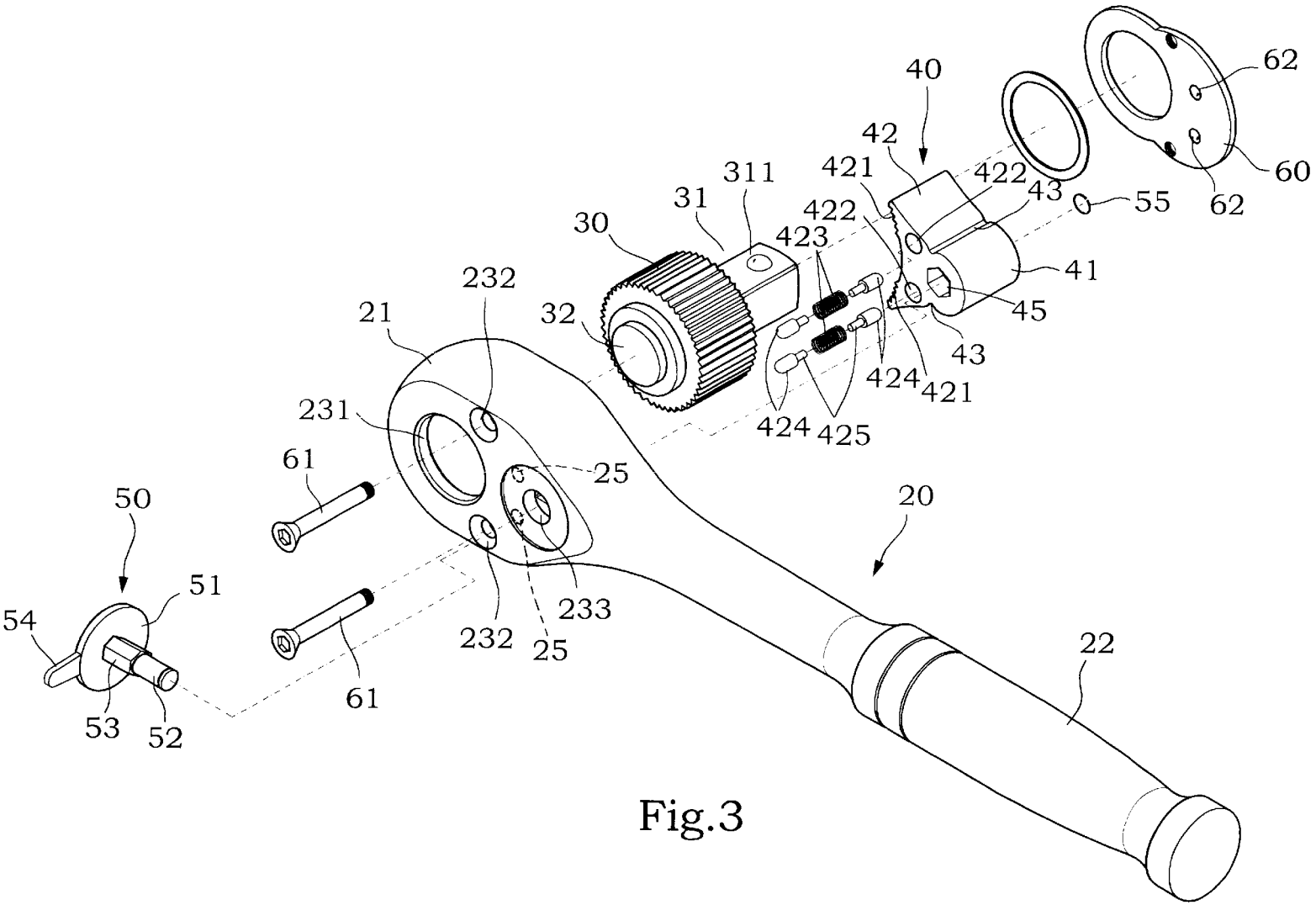
FIG. 3 is an exploded perspective view of the present invention.
Figure 4:
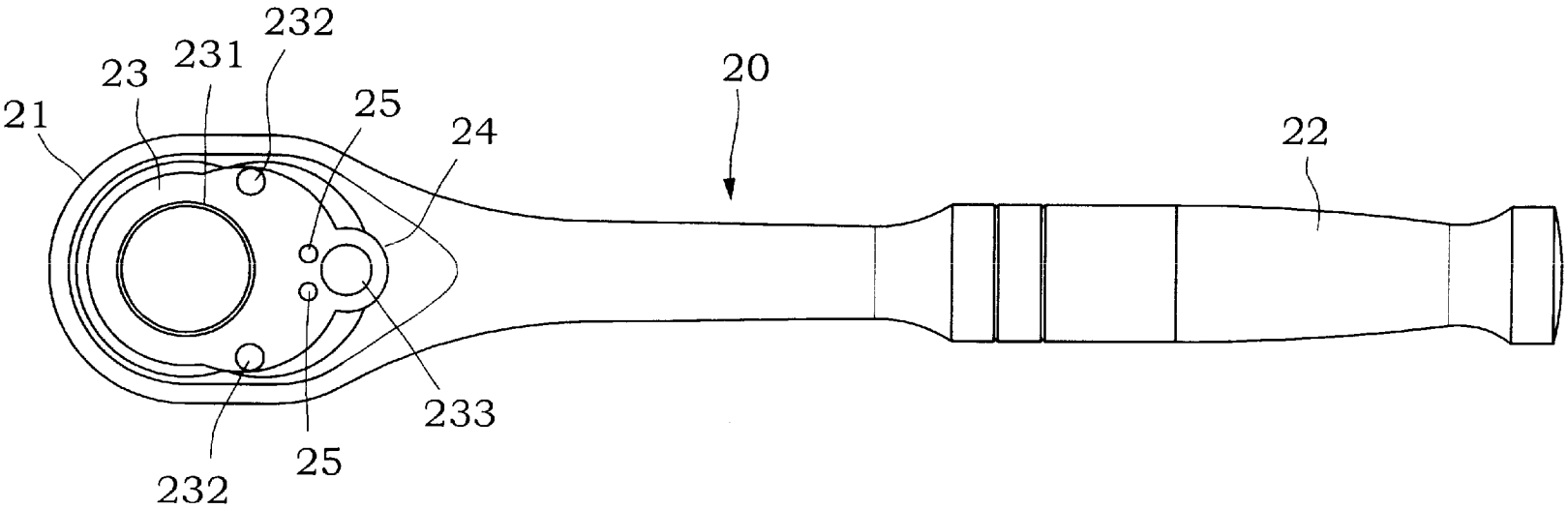
FIG. 4 is a plain view of a tool handle of the present invention.
Figure 5:
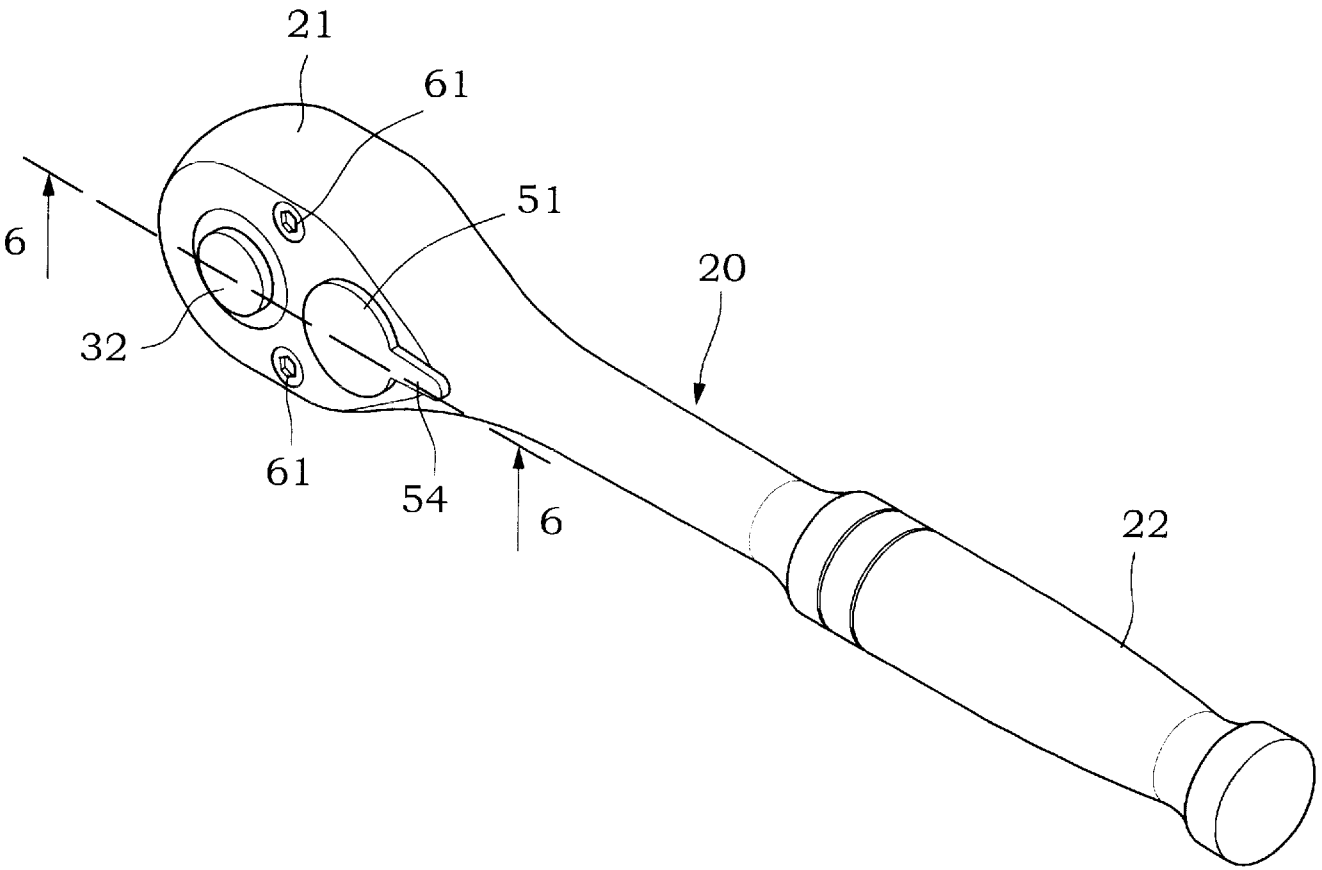
FIG. 5 is an assembled perspective view of the present invention.
Figure 6:
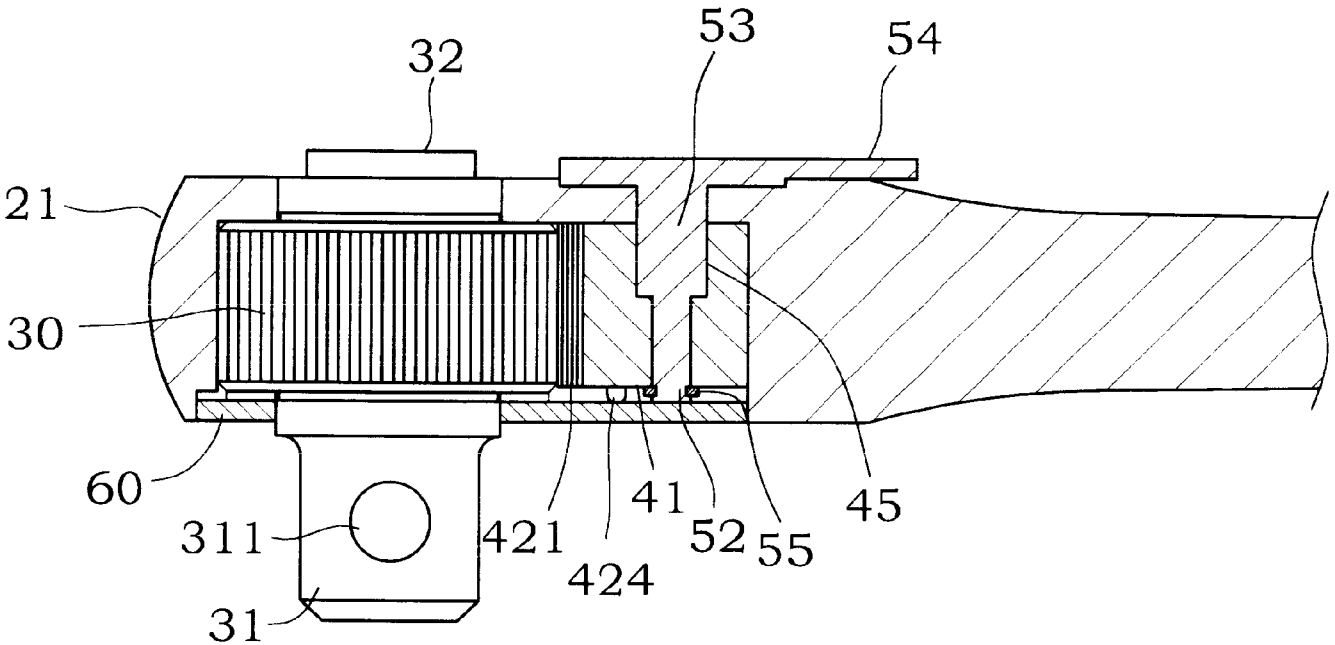
FIG. 6 is a sectional view taken along line 6—6 of FIG. 5.

Referring to FIGS. 3 to 6, the preferred embodiment of an improved adjusting structure for a ratchet wrench according to the present invention mainly includes a tool handle 20, a ratchet 30, an trigger block 40, an actuating structure 50, a seal piece 60, and a positioning assisting structure.

The tool handle 20 has a working end 21 at one end and a grip end 22 at the other end. The working end 21 has a chamber 23 with a downward open end disposed therein. A ratchet wheel opening 231, two screw holes 232, a shaft hole 233 are respectively to extend through a top wall of the chamber 23. The side wall of the chamber 23 that is proximate to the shaft hole 233 is provided with a curved positioning groove 24 having an opening that is in a contracted form.

The ratchet wheel 30 is disposed in the end portion of the chamber 23 with the ratchet wheel opening 231. The center of the ratchet wheel 30 is connected to a drive rod 31. The drive rod 31 is provided with a movable type insert control member 311 for stable coupling with a workpiece or another connecting member. The insert control member 311 is controlled via a push button 32 that extends out of the drive rod 30 and the ratchet wheel opening 231.

The trigger block 40 includes a curved block-like base portion 41 and a radially extending toothed block 42. Both sides of the trigger block 40 are respectively provided with recessed limiting grooves 43. The base portion 41 is disposed in the positioning groove 24 of the tool handle 20. The limiting grooves 43 on the two sides are disposed to receive the contracted side wall end of the positioning groove 24 so that the trigger block 40 is positioned in the positioning groove 24 and will not slip in the direction of the ratchet wheel 30. The toothed block 42 is a curved end face relative to the ratchet wheel 30 and has two ends respectively provided with toothed faces 421 formed by a plurality of ratchet teeth and respectively engageable with the ratchet wheel 30. The base portion 41 of the trigger block 40 is centrally provided with a polygonal hole 45.

The actuating structure 50 includes a disk portion 51, a shaft 52 disposed on one side of the disk portion 51, a polygonal block 53 provided on the shaft 52. The other side of the disk portion 51 extends radially to form a trigger rod 54. The disk portion 51 is provided outside the wall surface of the working end 21. The shaft 52 passes through the shaft hole 233 into the trigger block 40. The polygonal block 53 extends into the polygonal hole 45. The shaft 52 extends out of the trigger block 40 and has a bottom end retained by a C-clip 55 to prevent the adjusting structure 50 from upward disengagement. By manipulating the trigger rod 54, the trigger block 40 can be controlled to swing so that one of the toothed faces 421 engages with the ratchet wheel 30.

The seal piece 60 is disposed in the opening of the chamber 23, and is locked in position by passing two screw elements 61 through the screw holes 232.

In the positioning assisting structure, the toothed block 42 of the trigger block 40 is provided with two through holes 422 each of which has an elastic positioning element disposed therein. The elastic positioning element includes a spring 423. Two ends of the spring 423 are respectively provided with positioning balls 424. A positioning rod 425 disposed at an end portion of the positioning ball 424 passes through the spring 423 and is positioned therein. The wall surface of the chamber 23 and the side of the seal piece 60 corresponding to positions proximate to the two elastic positioning elements are respectively provided with hemispherical recesses 25, 62 for retaining circular end heads of the positioning balls 424.

Figure 8:
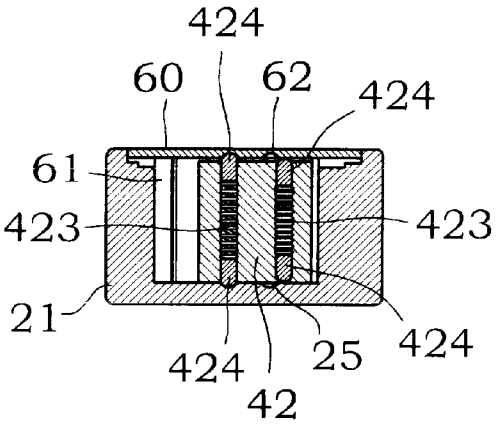
FIG. 8 is a sectional view taken along line 8—8 of FIG. 5.
Figure 7:
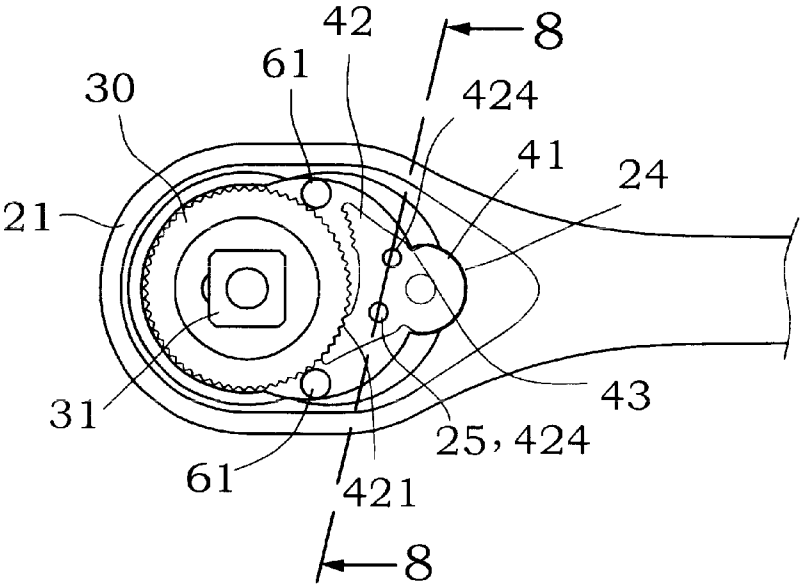
FIG. 7 is a schematic plan view illustrating operation of the present invention.
Figure 10:
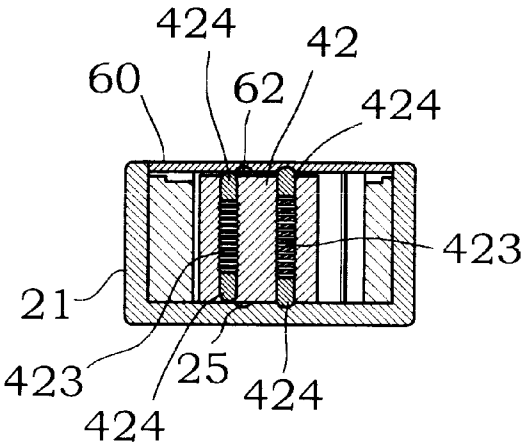
FIG. 10 is a sectional view taken along line 10—10 of FIG. 9.
Figure 9:
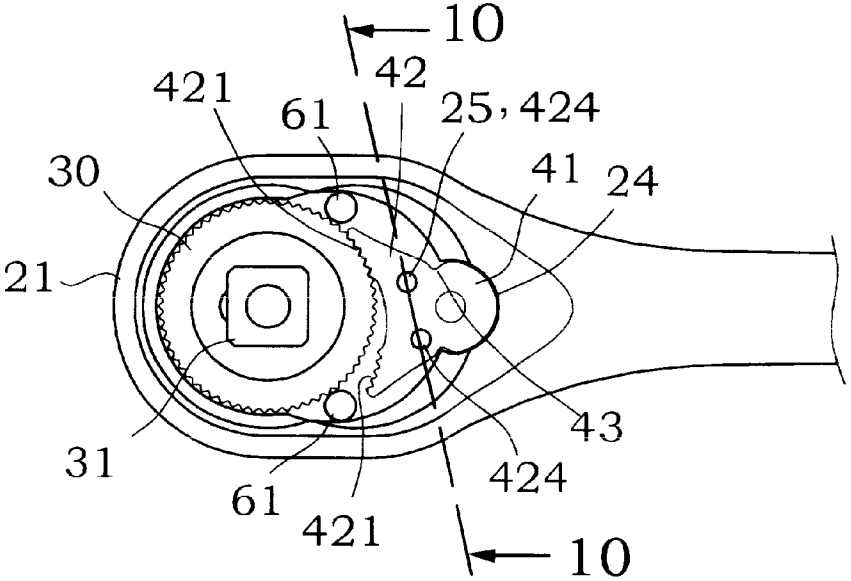
FIG. 9 is another schematic plan view illustrating operation of the present invention.

Referring to FIGS. 7 to 10, during operation of the movable wrench of the present invention, the trigger rod 54 is turned in a predetermined direction of action. The trigger rod 54 drives the disk portion 51 and the polygonal block 54. Since the polygonal block 53 fits in the polygonal groove 35 in the trigger block 40, the trigger block 40 can be brought to turn in the direction of the trigger rod 54 about an angle so that the toothed face 421 in that direction engages the toothed face of the ratchet wheel 30. At this time, when the movable wrench holds a workpiece with the drive rod 31 and drives in the direction of action, the toothed face 421 of the trigger block 40 retains the ratchet wheel 30 so that the wrench brings the ratchet wheel 30 and the workpiece to turn in the action direction to tighten or loosen the workpiece. On the contrary, when the movable wrench is worked in the other direction, the toothed face 421 of the trigger block 40 will be pushed away by the ratchet wheel 30 in a reverse direction so that the ratchet teeth do not engage and the movable wrench rotates idly to the original position without actuating the ratchet wheel 30. Since the positions of the two hemispherical recesses 25, 62 substantially correspond to the two elastic positioning elements, when the trigger block 40 is controlled by the trigger structure 50 to slant in a predetermined direction, with one of the toothed faces 421 engaging the ratchet wheel 30, the positioning balls 424 of one of the elastic positioning elements will follow the slanting direction of the trigger block 40 to move toward and are retained in the hemispherical recesses 25, 62 nearby, while the positioning balls 424 of the other elastic positioning elements will move out of the hemispherical recesses 25, 62, thereby achieving the function of assisting positioning of the trigger block 40. The configuration of the elastic positioning elements in which either end of the spring 423 abuts against a positioning ball 424 can eliminate the clearance between the trigger block 40, and the top wall of the chamber 23 and the seal piece 60 so that the arrangement is more secure. When one of the toothed faces 421 engages with the ratchet wheel 30, the positioning balls 4245 on the same side will be retained in the hemispherical recesses 25, 62 to stabilize engagement.

The present invention has the following advantages:

1. The present invention employs a ratchet wheel 30, a trigger block 40 and a trigger structure 50 to enable the movable wrench to drive a workpiece or to rotate idly so as to return to its original position.

2. The trigger block 40 is preformed as a block with the base portion thereof 41 disposed in the positioning groove 24 so as to be positioned therein. The configuration of the limiting groove 43 and the contracted end wall of the positioning groove 24 further enhances the positioning of the trigger block 40 so that it will not slip. This not only provides the advantage of quick assembly, positioning can also be done with the assembly operation in one time.

3. In the present invention, the trigger block 30 includes a toothed block 42 with two toothed faces 421 engageable with the ratchet wheel 30. Since the area of the toothed block 42 is large, the number of teeth on the toothed face 421 can also be increased to enlarge the area of engagement, which can increase the driving force of the trigger block 40, thereby increasing the torque of the wrench to drive the workpiece with a larger force without the toothed face of the trigger block 40 being broken.

4. The present invention has a positioning assisting structure. When the trigger block 40 is turned slantingly, and the toothed face 421 on one side thereof engages the ratchet wheel 30, the positioning balls 424 on the same side will displace to the nearby hemispherical recesses 25, 62 to stabilize engagement, so that the trigger block 40 can drive the ratchet wheel 30 to rotate in the action direction with a more stable balancing force.

5. All of the above advantageous features of the present invention enhance the operability and durability of the wrench.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved adjusting structure for a ratchet wrench, said ratchet wrench comprising a tool handle, said tool handle having one end provided with an open chamber, said chamber being sealed by a seal piece, said chamber being provided with an adjusting structure, said adjusting structure comprising:

a ratchet wheel disposed at an end portion of said chamber;

a positioning groove provided in a wall of another end portion of said chamber;

a trigger block having one end portion disposed in said positioning groove, the other end portion and said ratchet wheel being provided with two confronting toothed faces, said trigger block being swingable left and right in said positioning groove;

a trigger structure disposed outside said chamber and being operable to control said trigger block such that one of said toothed faces engages said ratchet wheel and a positioning assisting structure to position said trigger block between said chamber and said seal piece.

2. The improved adjusting structure for a ratchet wrench as claimed in claim 1, wherein said positioning assisting structure includes at least one hole in said trigger block for fitting therein an elastic positioning element, a wall surface of said chamber and said seal piece being respectively provided with two hemispherical recesses, said trigger block being turned via said trigger structure so as to slant, with said toothed face on one side thereof engaging said ratchet wheel, said elastic positioning element being elastically retained in said hemispherical recesses.

3. The improved adjusting structure for a ratchet wrench as claimed in claim 2, wherein said hemispherical recesses are provided in said wall surface of said chamber and said seal piece relative to positions proximate to said elastic positioning element.

4. The improved adjusting structure for a ratchet wrench as claimed in claim 2, wherein said elastic positioning element includes a spring disposed in said hole in said trigger block, said spring having two ends each of which abuts against a positioning ball.

5. The improved adjusting structure for a ratchet wrench as claimed in claim 4, wherein said positioning ball has an end portion provided with a positioning rod passing through and being retained in said spring.

6. The improved adjusting structure for a ratchet wrench as claimed in claim 1, wherein one end of said trigger block is a circular block-shaped base portion, the other end portion thereof is a toothed block that expands radially outward from said base portion, said toothed block having two ends each of which has a toothed face.

7. The improved adjusting structure for a ratchet wrench as claimed in claim 1, wherein two sides of said trigger block are respectively provided with recessed limiting grooves for insertion therein wall ends of an opening portion of said positioning groove when said trigger block slants, thereby preventing said trigger block from slipping in the direction of said ratchet wheel.

8. The improved adjusting structure for a ratchet wrench as claimed in claim 1, wherein said trigger block is provided with a polygonal hole.

9. The improved adjusting structure for a ratchet wrench as claimed in claim 8, wherein said trigger structure includes a shaft, said shaft being provided with a polygonal block, said shaft extending through said trigger block, said polygonal block being fitted into said polygonal hole.

* * * * *